US008004547B2

(12) United States Patent
Saga

(10) Patent No.: US 8,004,547 B2
(45) Date of Patent: Aug. 23, 2011

(54) THERMAL PRINTER AND METHOD OF CONTROLLING THE SAME

(75) Inventor: Kengo Saga, Shizuoka-ken (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 168 days.

(21) Appl. No.: 12/553,381

(22) Filed: Sep. 3, 2009

(65) Prior Publication Data

US 2010/0060706 A1 Mar. 11, 2010

(30) Foreign Application Priority Data

Sep. 8, 2008 (JP) ..... 2008-230107

(51) Int. Cl.
*B41J 2/32* (2006.01)

(52) U.S. Cl. ..... 347/171; 347/218

(58) Field of Classification Search ..... 347/171, 347/218; 400/120.01, 82, 188
See application file for complete search history.

(56) References Cited

U.S. PATENT DOCUMENTS

| | | | | |
|---|---|---|---|---|
| 7,839,425 | B2 * | 11/2010 | Morrison | 347/171 |
| 7,891,893 | B2 * | 2/2011 | Sekino et al. | 400/188 |
| 2003/0112318 | A1 * | 6/2003 | Long et al. | 347/171 |
| 2009/0079779 | A1 | 3/2009 | Saga | |

FOREIGN PATENT DOCUMENTS

JP 2001071569 3/2001

OTHER PUBLICATIONS

Machine-generated translation of JP 2001-071569, published on Mar. 2001.*

* cited by examiner

*Primary Examiner* — Huan H Tran
(74) *Attorney, Agent, or Firm* — Turocy & Watson, LLP

(57) ABSTRACT

Previously setting the front end of printed thermal paper at a second position before a second thermal head, when a next print job is double-side printing, at a first position before a first thermal head, when a next print job is one-side printing with the first thermal head, and at the second position before the second thermal head, when a next print job is one-side printing with the second thermal head.

17 Claims, 7 Drawing Sheets

THERMAL PRINTER AND METHOD OF CONTROLLING THE SAME

CROSS-REFERENCE TO RELATED APPLICATION

This application is based upon and claims the benefit of priority from prior Japanese Patent Application No. 2008-230107, filed Sep. 8, 2008, the entire contents of which are incorporated herein by reference.

TECHNICAL FIELD

The present invention relates to a thermal printer using thermal paper having a thermosensitive on both sides, and a method of controlling the thermal printer.

BACKGROUND

There is a conventional thermal printer, which is provided with a thermal head at positions corresponding to one side and the other side of thermal paper having a thermosensitive layer on both sides, and prints both sides of thermal paper by operating both thermal heads, or prints one side of thermal paper by operating one of the thermal heads (e.g., Jpn. PAT. Appln. KOKAI Publication No. 2001-71569).

In such a thermal printer, printed thermal paper is conveyed to the end of a cutter, cut by the cutter, and supplied to a user.

The front end of the printed thermal paper cut by a cutter is left at a position corresponding to the cutter. The front end of thermal paper must be returned to a position before a thermal head from the cutter for the next printing, and the printing speed is decreased.

It is considered to solve the problem that the end of printed and cut thermal paper is immediately returned to a position before a cutter. However, two thermal heads are provided for double-side printing, and one of the thermal heads is used for one-side printing. It is thus difficult to prevent slowdown of the printing speed only by returning the front end of thermal paper to a position before a cutter.

SUMMARY

It is an object of the present invention to provide a thermal printer, which is configured to reduce much time required before starting either both-side printing and one-side printing, and increase a printing speed, thereby improving the print quality, and a method of controlling the thermal printer.

A thermal printer according to an aspect this invention comprises: thermal paper, which has a thermosensitive layer on both sides, and is fed in a predetermined direction; a first thermal head, which is provided at a position in the thermal paper feeding direction, and prints one side of the thermal paper; a second thermal head, which is provided at a position apart from the first thermal head in the thermal paper feeding direction, and prints the other side of the thermal paper; a first control section, which selectively executes both-side printing with both thermal heads, and one-side printing with one of the thermal head; a second control section, which previously sets the front end of the thermal paper at a position before the thermal head provided in the upstream in the thermal paper feeding direction, when the first control section executes double-side printing; and a third control section, which previously sets the front end of the thermal paper at a position before the thermal head to be used, when the first control section executes one-side printing.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

DESCRIPTION OF THE DRAWINGS

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION

An embodiment of the invention will be explained hereinafter with reference to the accompanying drawings. First, a configuration of an essential part is shown in FIG. 1.

Figure 1:
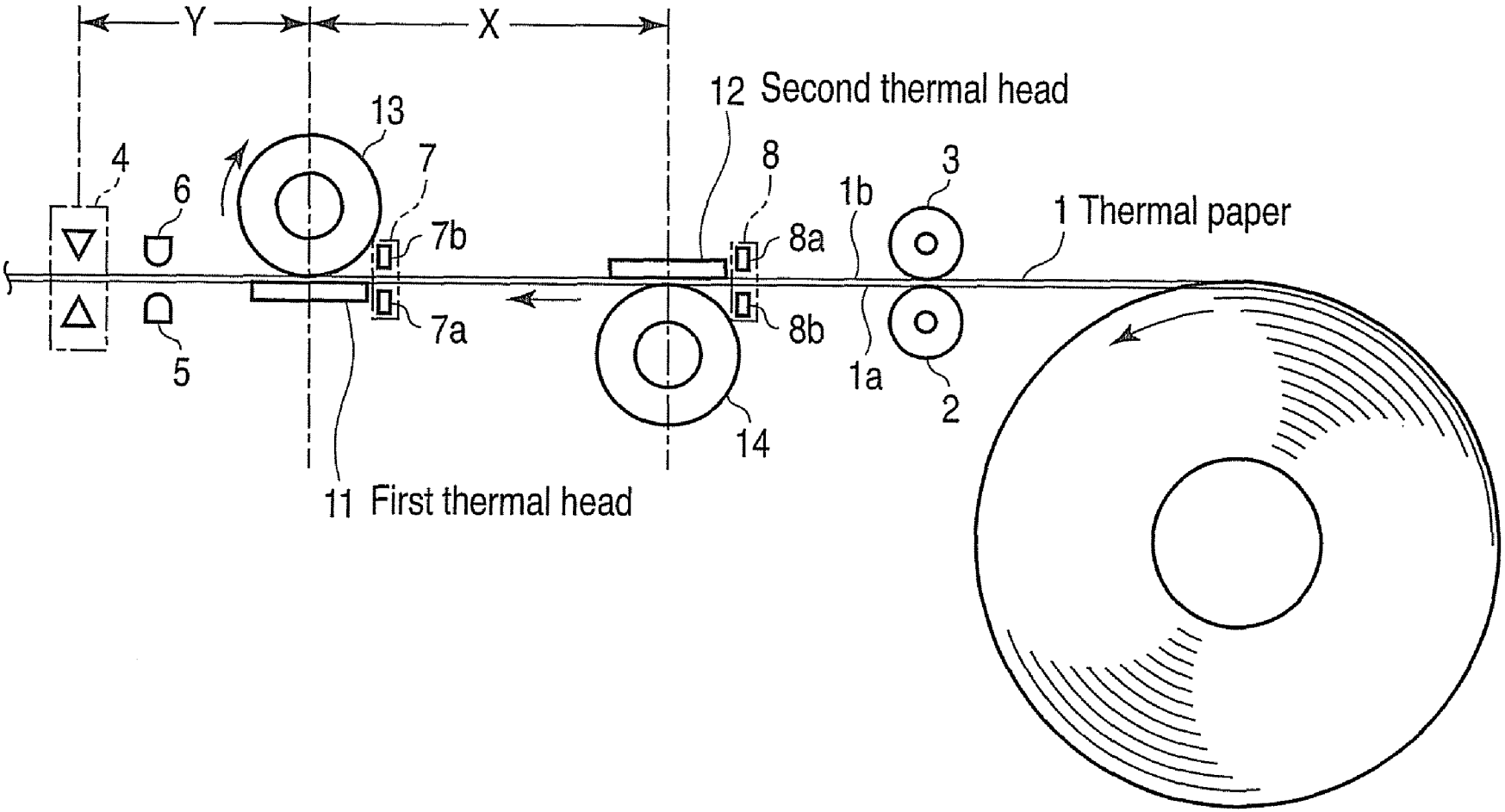
FIG. 1 is a diagram, showing a configuration of an essential part of an embodiment of the invention.

In FIG. 1, a reference numeral 1 denotes thermal paper. The thermal paper 1 has a thermosensitive layer on one side (a front side) 1*a* and the other side (a back side) 1*b*. The rear end side of the thermal paper is wound like a roll with the front side 1*a* faced inside, and the front end side is fed in a predetermined direction (in the direction of an arrow in the drawing) by paper-feeding rollers 2 and 3. The thermosensitive layers are made of material, which turns black or red, for example, when it is heated to a temperature higher than a predetermined value.

Along the feeding direction of the thermal paper 1, there are provided a first thermal head 11 which contacts the front side 1*a* of the thermal paper 1, and a second thermal head 12 which contacts the back side 1*b* of the thermal paper. The first and second thermal heads 11 and 12 are shaped to extend in the direction perpendicular to the thermal paper 1 feeding direction, or in the width direction of the thermal paper 1, and provided at positions apart each other along the thermal paper 1 feeding direction. The first thermal head 11 is positioned in the downstream of the second thermal head 12 in the thermal paper 1 feeding direction. A first platen roller 13 is provided at a position opposite to the first thermal head 11 through the thermal paper 1, and a second platen roller 14 is provided at a position opposite to the second thermal head 12 through the thermal paper 1. A cutter 4 for cutting the thermal paper 1 is provided in the downstream of the first thermal head 11 in the paper-feeding direction.

The distance between the second thermal head 12 in the upstream and the first thermal head 11 in the downstream is X, and the distance between the first thermal head 11 and the cutter 4 is Y.

First and second mark sensors 5 and 6 are provided between the first thermal head 11 and cutter 4, as means for detecting a defect in the first and second thermal heads 11 and 12. The first mark sensor 5 is a reflection type optical sensor, which emits light to the front side of the thermal paper 1, takes in a reflected light from the front side, and detects a front-side mark Ma printed on the front side of the thermal paper 1 as described later. The second mark sensor 6 is a reflection type optical sensor, which emits light to the back side of the thermal paper 1, takes in a reflected light from the back side, and detects a backside mark Mb printed on the back side of the thermal paper 1.

A first front-end sensor 7 is provided at a position before the first thermal head 11 in the thermal paper 1 feeding direction. A second front-end sensor 8 is provided at a position before the second thermal head 12 in the thermal paper 1 feeding direction. The first front-end sensor 7 is a photocoupler, which comprises a light-emitting element 7*a* and a light-receiving element 7*b*, opposing each other through the thermal paper 1 feeding path, and detects whether the front end of the thermal paper 1 is set at the position before the first thermal head 11, by changes in the light received by the light-receiving element 7*b*, which receives the light emitted from the light-emitting element 7*a*. The second front-end sensor 8 is a photocoupler, which comprises a light-emitting element 8*a* and a light-receiving element 8*b*, opposing each other through the thermal paper 1 feeding path, and detects whether the front end of the thermal paper 1 is set at the position before the second thermal head 12, by changes in the light received by the light-receiving element 8*b*, which receives the light emitted from the light-emitting element 8*a*.

Figure 2:
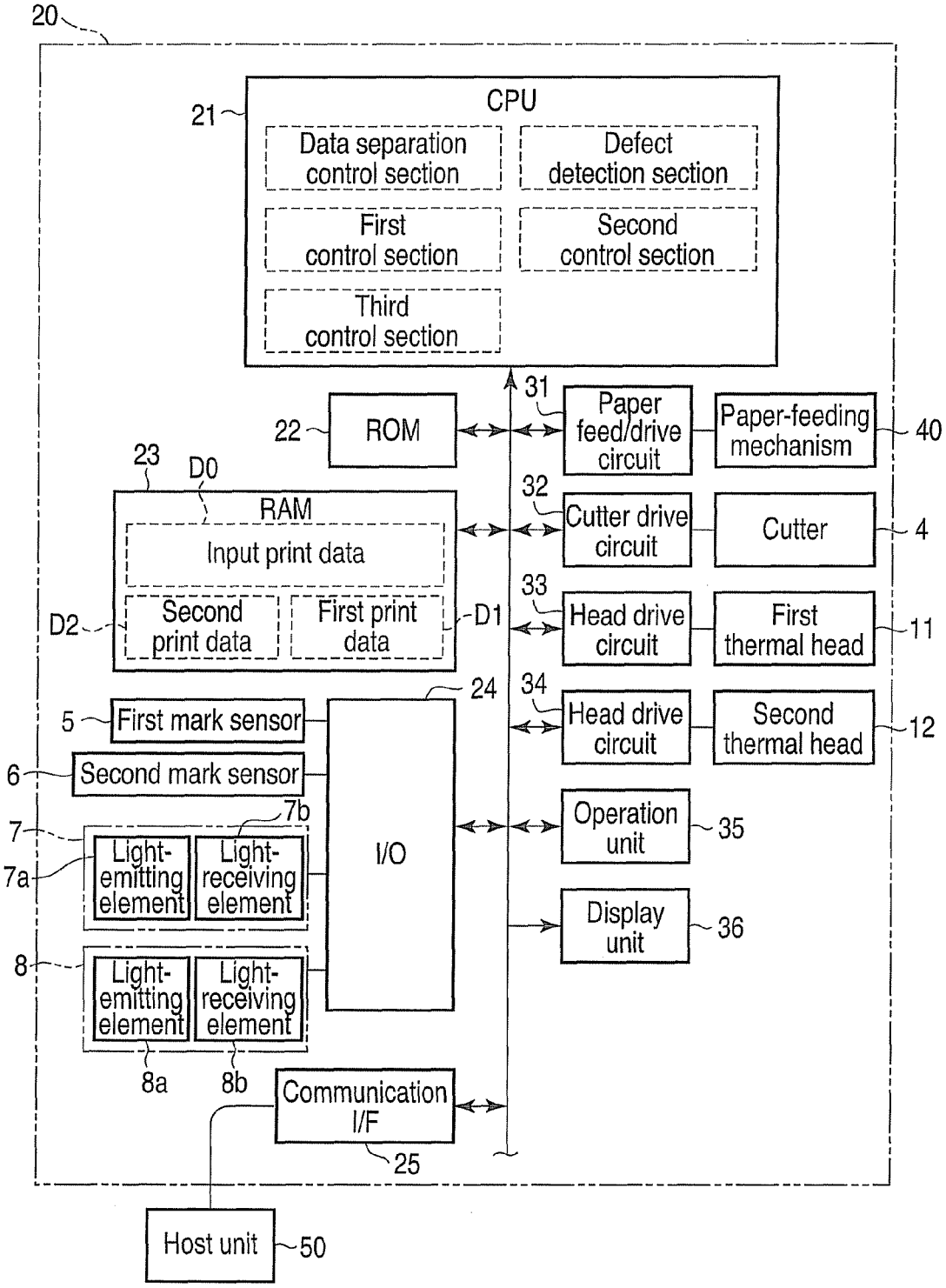
FIG. 2 is a block diagram of a control circuit of an embodiment of the invention.

FIG. 2 shows a control circuit of a thermal printer 20, which includes the configuration of FIG. 1. A main control unit CPU 21 is connected to a ROM 22 for storing a control program, a RAM 23 for storing data, an input/output unit (I/O) 24, a communication interface 25, a paper feed/drive circuit 31, a cutter drive circuit 32, head drive circuits 33 and 34, an operation unit 35 for setting operating conditions, and a display unit 36. The input/output unit 24 is connected to the first mark sensor 5, second mark sensor 6, first front-end sensor 7, and second front-end sensor 8. The communication interface 25 is connected to an external host unit 50. The paper feed/drive circuit 31 drives a paper-feeding mechanism, which includes the paper feeding-rollers 2 and 3, and paper-feeding path 4. The cutter drive circuit 32 drives the cutter 4. The head drive circuits 33 and 34 drive the first and second thermal heads 11 and 12, respectively.

The CPU 21 has the following means (1) to (5) as primary functions.

(1) A data separation control section, which separates print data D0 supplied from an external host unit 50 into first print data D1 for the front side 1*a* of the thermal paper 1, and second print data D2 for the back side 1*b* of the thermal paper 1. The print data D0, first print data D1, and second print data D2 are stored in the RAM 23.

(2) A defect detection section, which detects a defect in the first and second thermal heads 11 and 12, based on the detection results of the first and second mark sensors 5 and 6. The defect detection section includes a means for printing a front-side mark Ma on the front side 1*a* of the thermal paper 1 with the first thermal head 11, a means for printing a backside mark Mb on the back side 1*b* of the thermal paper 1 with the second thermal head 12, a means which determines the first thermal head 11 to be defective when the first mark sensor 5 does not detect a front-side mark Ma, and a means which determines the second thermal head to be defective when the second mark sensor 6 does not detect a backside mark Mb.

(3) A first control section, which selectively executes double-side printing with both first and second thermal heads 11 and 12, and one-side printing with one of the thermal heads. In the normal time when the defect detection means detects no defect, the first control section executes double-side printing, by feeding the thermal paper 1, and operating the second thermal head 12 according to the second print data D2, and then operating the first thermal head 11 according to the first print data D1. When the defect detection means detects a defect in the second thermal head, the first control section executes one-side printing, by feeding the thermal paper 1, and operating the first thermal head 11 according to the first and second print data D1 and D2. When the defect detection means detects a defect in the first thermal head, the first control section executes one-side printing, by feeding the thermal paper 1, and operating the second thermal head 12 according to the first and second print data D1 and D2.

(4) A second control section, which previously sets the front end of the thermal paper 1 at a position before the second thermal head 12 (a second position) in the upstream of the first thermal head 11, based on the detection result of the front-end sensor 8, at the time of executing double-side printing with both first and second thermal heads 11 and 12.

(5) A third control section, which previously sets the front end of the thermal paper 1 at the second position before the second thermal head 12, based on the detection result of the front-end sensor 8, at the time of executing one-side printing with the second thermal head 12, and sets the front end of the thermal paper 1 at a position before the first thermal head 11 (a first position), based on the detection result of the front-end sensor 8, at the time of executing one-side printing with the first thermal head 11.

Figure 3:
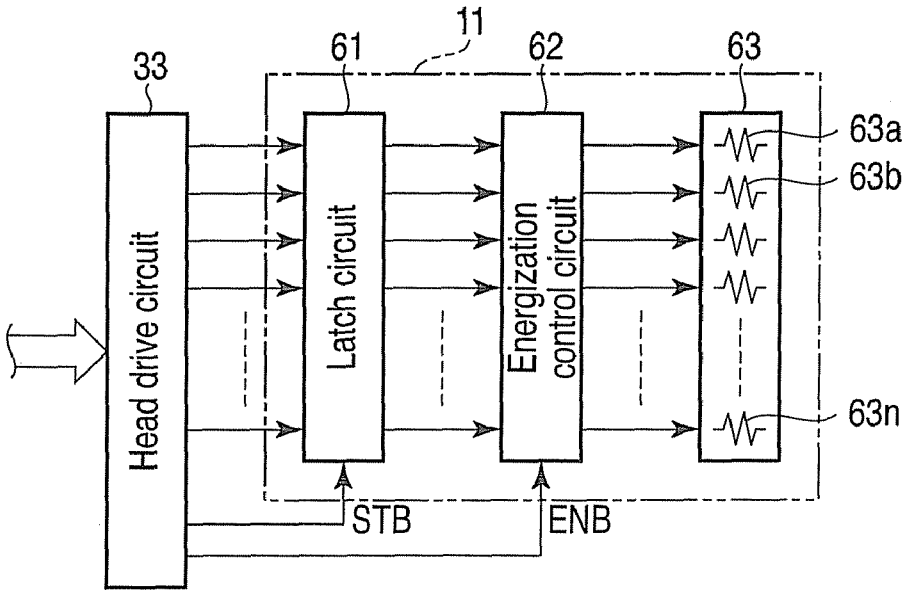
FIG. 3 is a block diagram showing a concrete configuration of a thermal head in an embodiment of the invention.

The first thermal head 11 comprises a latch circuit 61, an energization control circuit 62, and an edge head 63, as shown in FIG. 3. The edge head 63 has a number of linearly arranged heat transfer heating elements 63*a*, 63*b*, . . . 63*n*. The latch circuit 61 latches the first print data D1 supplied from the head drive circuit 33 for every line according to a strobe signal STB supplied from the head drive circuit 33. The energization control circuit 62 controls energization of the heating elements 63*a*, 63*b*, . . . 63*n* of the edge head 63, according to the data in the latch circuit 61, at the timing when the enable signal ENB supplied from the head drive circuit 33 is activated. The second thermal head 12 has the same configuration as the first thermal head 11. An explanation thereof is omitted.

Figure 4:
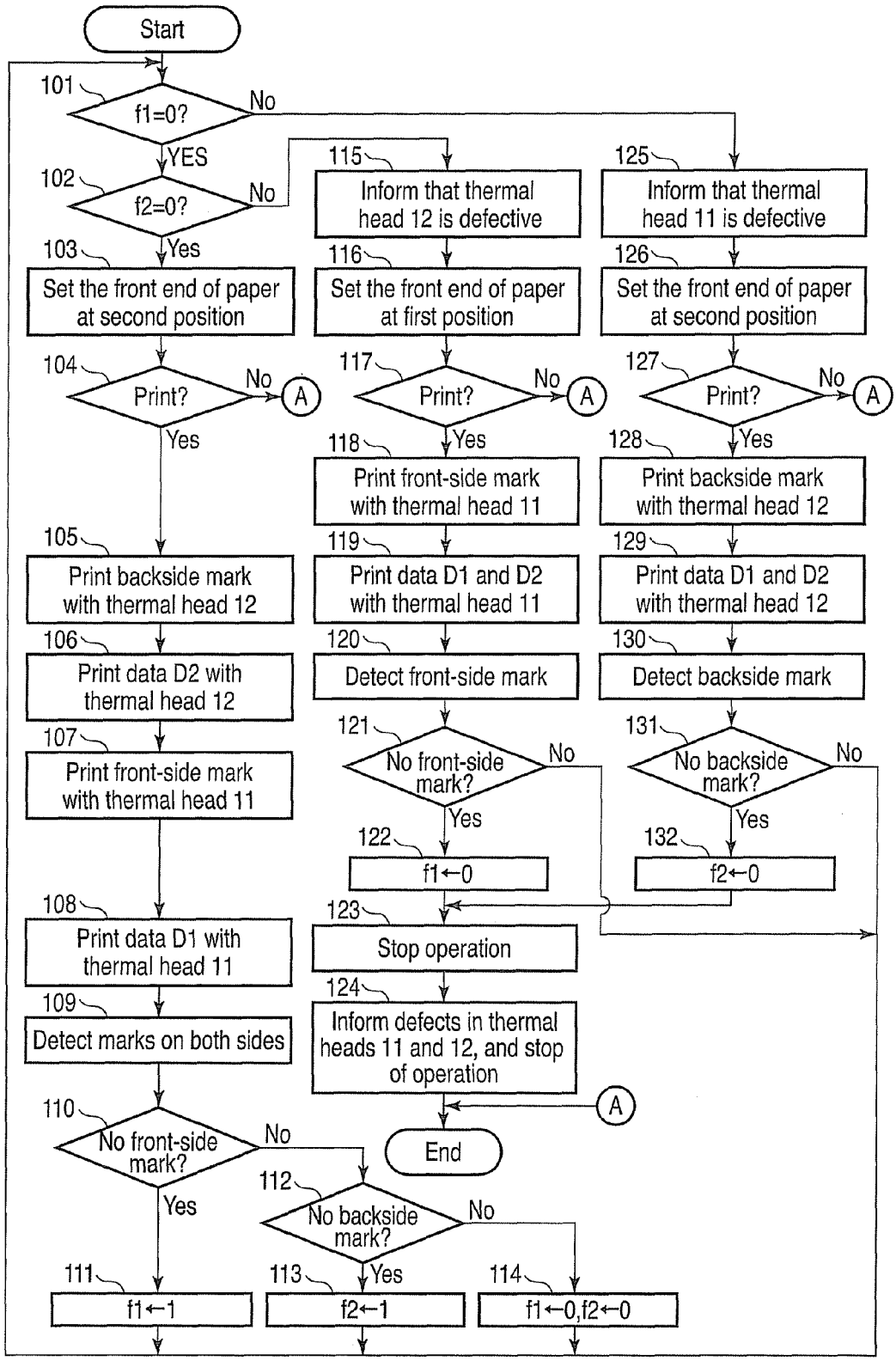
FIG. 4 is a flowchart for explaining operations of an embodiment of the invention.

Next, the functions of the embodiment will be explained with reference to the flowchart of FIG. 4.

Figure 5:
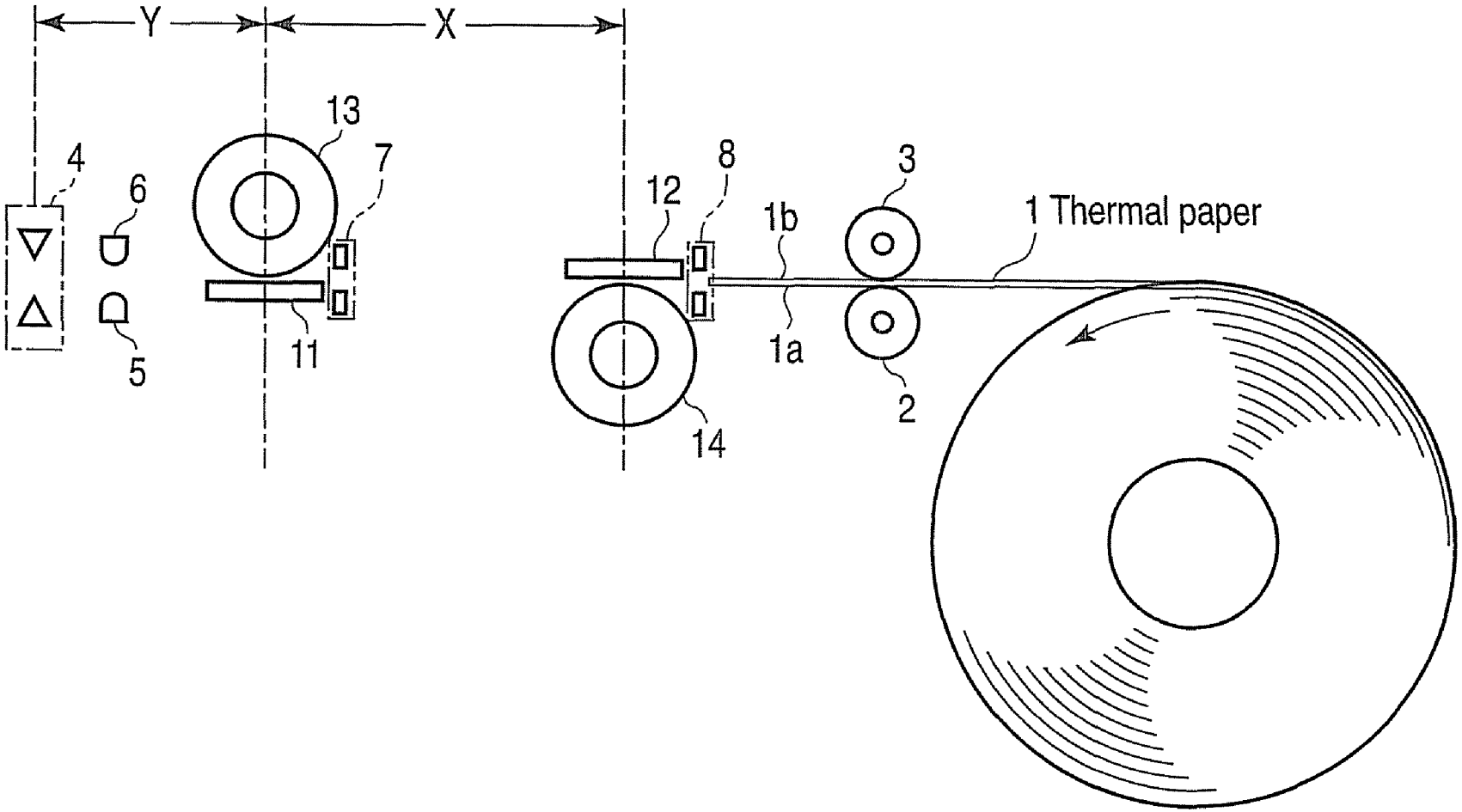
FIG. 5 is a diagram showing a state, in which the front end of thermal paper is set at a position before a second thermal head in an embodiment of the invention.

Flags f1 and f2 are checked to determine whether on the first and second thermal heads 11 and 12 are defective (steps 101, 102). When the flags f1 and f2 are "0" (YES in steps 101 and 102), the first and second thermal heads 11 and 12 are determined not to be defective, and the front end of the thermal paper 1 is set at a second position before the second thermal head 12 as shown in FIG. 5 (step 103). The front end of the thermal paper 1 is set at the second position by reverse rotation of the paper-feeding rollers 2 and 3, when the last time double-side printing is completed and the front end of the thermal paper 1 is cut by the cutter 4. In this state, whether a next print job exists is checked (step 104).

Figure 6:
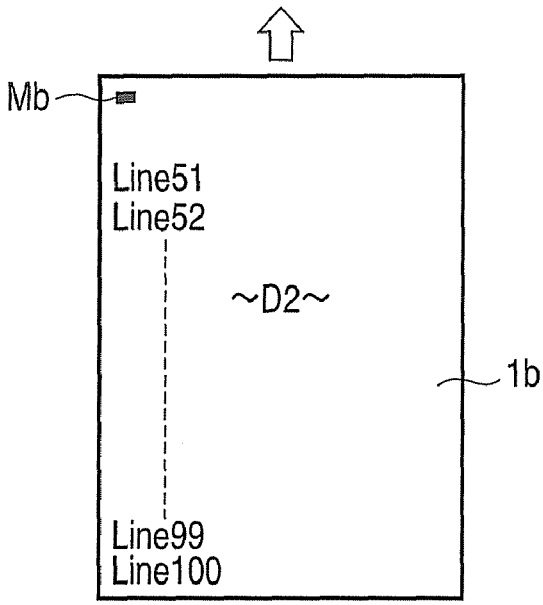
FIG. 6 is a diagram showing a state, in which a backside mark and print data D2 are printed on the back side of thermal paper by double-side printing, in an embodiment of the invention.

When a print job is found (YES in step 104), the thermal paper 1 is fed by forward rotation of the paper-feeding rollers 2 and 3, and the second thermal head 12 prints a square black backside mark Mb at the front left side position on the back side 1*b* of the thermal paper 1, as shown in FIG. 6 (step 105), and then the second thermal head 12 prints the second print data D2 on the back side 1*b* of the thermal paper 1 (step 106). When the front end of the thermal paper 1 is set at the first thermal head 11 as shown in FIG. 7, the first thermal head 11 prints a square black front-side mark a at the front left side position on the front side 1*a* of the thermal paper 1 (step 107), and then first thermal head 11 prints the first print data D1 on the front side 1*a* of the thermal paper 1 (step 108).

As the double-side printing advances, the first and second mark sensors 5 and 6 detect the front-side mark Ma and backside mark Mb printed on both sides of the thermal paper 1 (step 109). When the first mark sensor does not detect the front-side mark Ma (YES in step 110), the flag f1 to determine whether the first thermal head 11 is defective is set to "1" (step 111).

When the second mark sensor does not detect the backside mark Mb even if the first mark sensor 5 detects the front-side mark Ma (No in step 110, YES in step 112), the flag f2 to determine whether the second thermal head 12 is defective is set to "1" (step 113). When the first and second mark sensors 5 and 6 do not detect the front-side mark Ma and backside mark Mb (NO in step 110, NO in step 112), the flags f1 and f2 are set to "0" (step 114).

Figure 7:
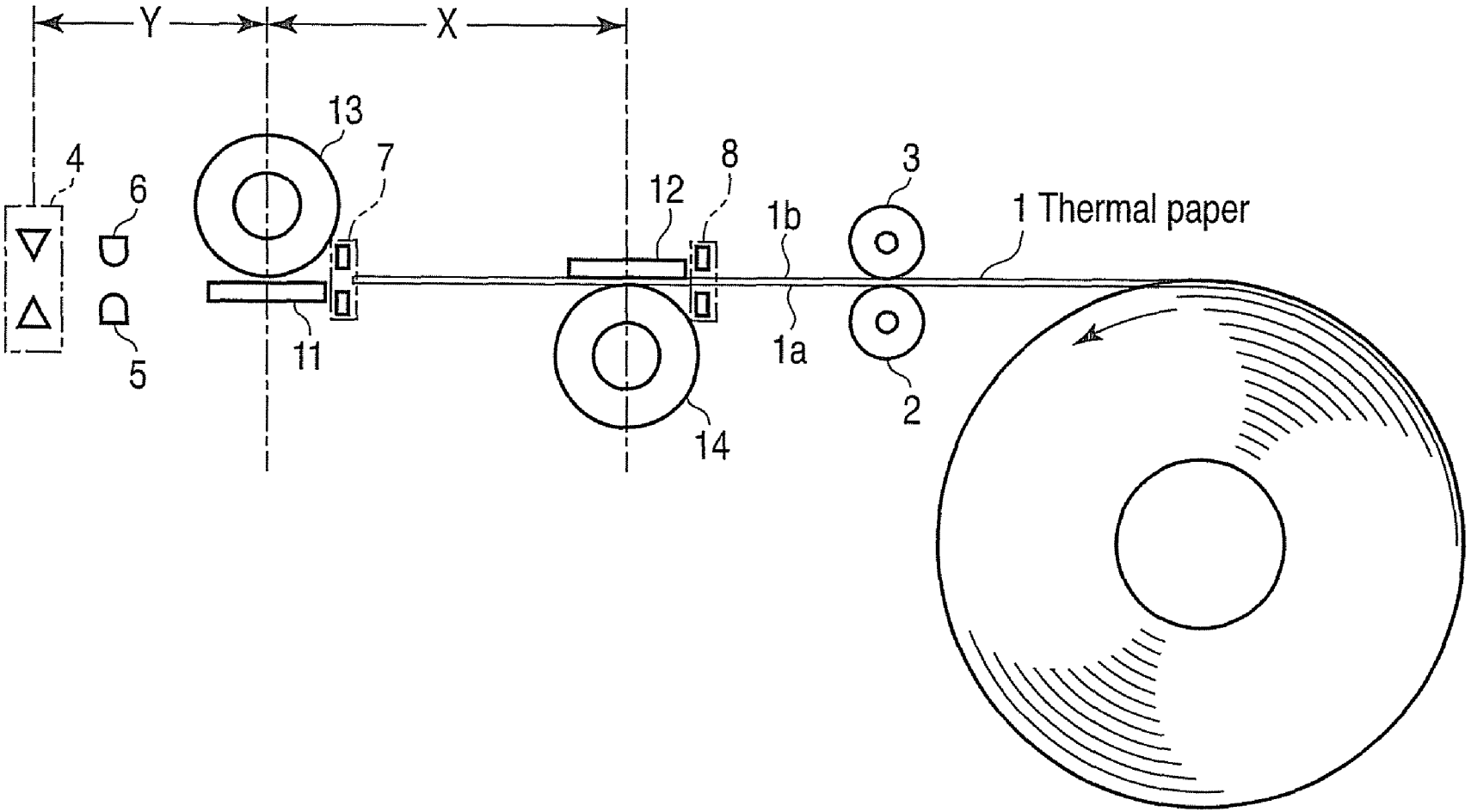
FIG. 7 is a diagram showing a state, in which the front end of thermal paper is set at a position before a first thermal head in an embodiment of the invention.
Figure 8:
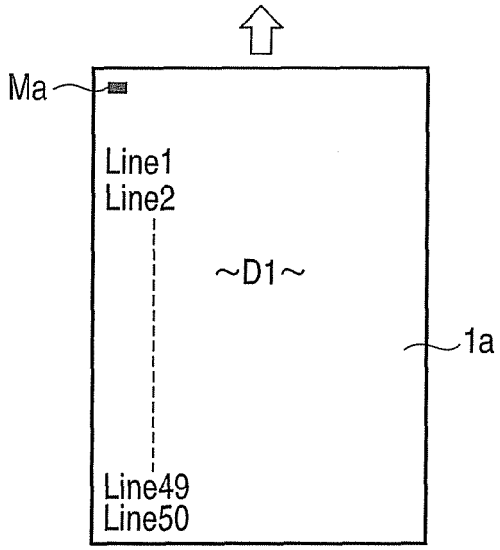
FIG. 8 is a diagram showing a state, in which a front-side mark and print data D1 are printed on the front side of thermal paper by double-side printing, in an embodiment of the invention.

When the flag F1 is "0" (YES in step 101) and the flag F2 is "1" (NO in step 102), the first thermal head 11 is determined to be not defective and the second thermal head 12 is determined to be defective, and the display unit 36 informs the user of the defect in the second thermal head 12 (step 115), and the front end of the thermal paper 1 is set at a first position before the first thermal head 11 as shown in FIG. 7 (step 116). The front end of the thermal paper 1 is set at the first position by reverse rotation of the paper-feeding rollers 2 and 3, when the last time double-side printing is completed and the front end of the thermal paper 1 is cut by the cutter 4. In this state, whether a next print job exists is checked (step 117).

Figure 9:
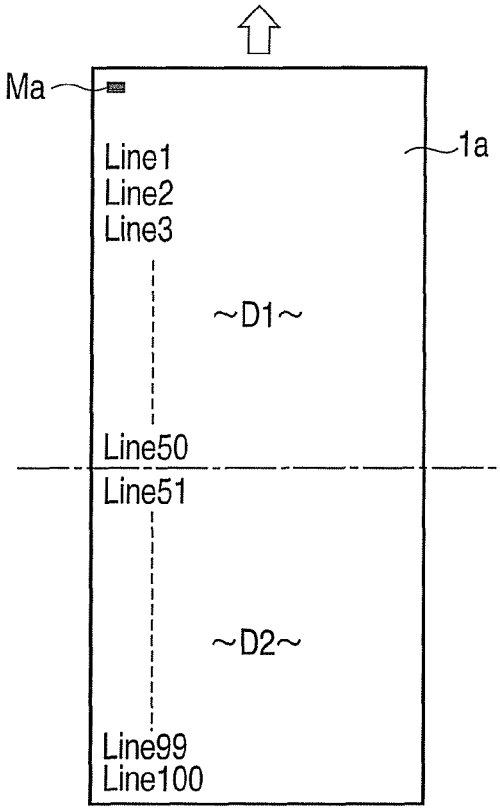
FIG. 9 is a diagram showing a state, in which a front-side mark and print data D1 and D2 are printed on the front side of thermal paper by one-side printing with a first thermal head, in an embodiment of the invention.

When a print job is found (YES in step 117), the thermal paper 1 is fed by forward rotation of the paper-feeding rollers 2 and 3, and the first thermal head 11 prints a front-side mark Ma at the front left side position on the front side 1*a* of the thermal paper 1 as shown in FIG. 9 (step 118), and then the first thermal head 11 prints the first and second print data D1 and D2 on the front side 1*a* of the thermal paper 1 (step 119).

As the one-side printing with the first thermal head 11 advances, the first mark sensor 5 detects the front-side mark Ma printed on the front side of the thermal paper 1 (step 120). When the first mark sensor 5 detects the front-side mark Ma (YES in step 121), the first thermal head 11 is determined to be not defective, and a next print job is waited. However, if the first mark sensor 5 does not detect the front-side mark Ma (NO in step 121), the flag f1 is set to "0" (step 122), and the operation of the corresponding thermal head is stopped (step 123). At the same time, the display unit 36 informs the user of the defect in the first and second thermal heads 11 and 12 and the stop of the operation (step 124). Receiving the information, the user asks for repair.

When the flag f1 is "1" (NO in step 101, the flag f2 may be "1"), the first thermal head 11 is determined to be defective and the second thermal head 12 is determined to be not defective, and the display 36 informs the user of the defect in the first thermal head 11 (step 125), and as shown in FIG. 5, the front end of the thermal paper 1 is set at the second position before the second thermal head 12 (step 126). In this state, whether a next print jog exists is checked (step 127).

Figure 10:
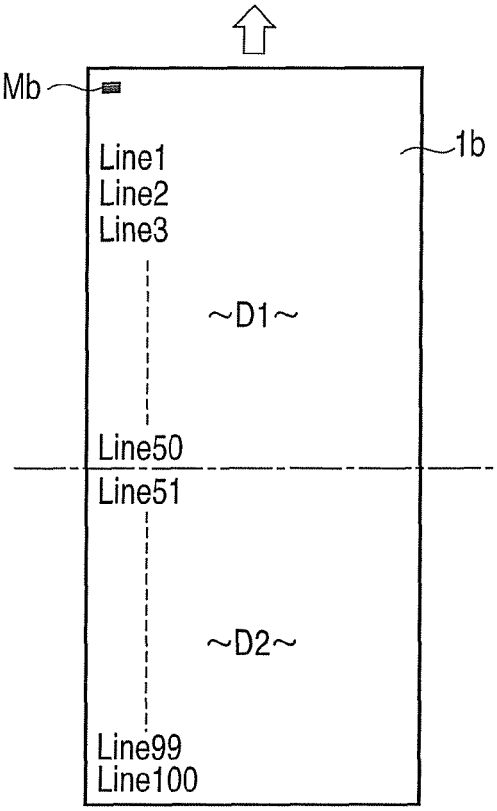
FIG. 10 is a diagram showing a state, in which a backside mark and print data D1 and D2 are printed on the back side of thermal paper by one-side printing with a second thermal head, in an embodiment of the invention.

When a print job is found (YES in step 127), the thermal paper 1 is fed by forward rotation of the paper-feeding rollers 2 and 3, and the second thermal head 12 prints a backside mark Mb at the front left side position on the back side 1*a* of the thermal paper 1 as shown in FIG. 10 (step 128), and then the second thermal head 12 prints the first and second print data D1 and D2 on the back side 1*b* of the thermal paper 1 (step 129).

As the one-side printing with the second thermal head 12 advances, the second mark sensor 6 detects the backside mark Mb printed on the back side of the thermal paper 1 (step 130). When the second mark sensor 6 detects the backside mark Mb (YES in step 131), the second thermal head 12 is determined to be not defective, and a next print job is waited. However, if the second mark sensor 6 does not detect the backside mark Mb (NO in step 131), the flag f2 is set to "0" (step 132), and the operation of the corresponding thermal head is stopped (step 123). At the same time, the display unit 36 informs the user of the defect in the first and second thermal heads 11 and 12 and the stop of operation (step 124).

As described above, the front end of the printed thermal paper 1 is previously set at a second position before the second thermal head 12 in the case in which a next print job is double-printing. The front end of the printed thermal paper 1 is previously set at a first position before the first thermal head 11 in the case in which a next print job is one-side printing with the first thermal head 11, and a second position before the second thermal head 12 in the case in which a next print job is one-side printing with the second thermal head 12. Therefore, the time required before starting printing can be greatly reduced in either double-side printing or one-side printing. This increases the printing speed, and improves the reliability as a thermal printer.

In the above embodiment, the front-side mark Ma and backside mark Mb are printed at the left side position in the front end of the thermal paper 1. The printing position is not limited to this. The printing position may be appropriately set considering the positions and relationship between the first and second mark sensors 5 and 6. Further, a reflection type optical sensor is used as first and second mark sensors, and a photocoupler is used as first and second position sensors. The kinds of the sensors are not limited to them. The kinds of the sensors may be appropriately selected.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A thermal printer comprising:

thermal paper, which has a thermosensitive layer on both sides, and is fed in a predetermined direction;

a first thermal head, which is provided at a position in the thermal paper feeding direction, and prints one side of the thermal paper;

a second thermal head, which is provided at a position apart from the first thermal head in the thermal paper feeding direction, and prints the other side of the thermal paper;

a first control section, which selectively executes both-side printing with both thermal heads, and one-side printing with one of the thermal head;

a second control section, which previously sets the front end of the thermal paper at a position before the thermal head provided in the upstream in the thermal paper feeding direction, when the first control section executes double-side printing; and a third control section, which previously sets the front end of the thermal paper at a position before the thermal head to be used, when the first control section executes one-side printing.

2. The printer according to claim 1, further comprising a defect detection section which detects a defect in the thermal heads.

3. The printer according to claim 2, wherein the first control section executes double-side printing, when the defect detection section detect no defect, the first control section executes one-side printing with the second thermal head, when the defect detection section detects a defect in the first thermal head, and the first control section executes one-side printing with the first thermal head, when the defect detection section detects a defect in the second thermal head.

4. The printer according to claim 2, wherein the defect detection section includes:

a means for printing a mark on one side of the thermal paper with the first thermal head;

a means for printing a mark on the other side of the thermal paper with the second thermal head;

a first mark sensor which detects a mark printed on one side of the thermal paper;

a second mark sensor which detects a mark printed on the other side of the thermal paper;

a means for determining the first thermal head to be defective, when the first mark sensor does not detect a mark;

a means for determining the second thermal head to be defective, when the second mark sensor does not detect a mark.

5. The printer according to claim 2, further comprising a data separation control section, which separates print data into first print data for one side of the thermal paper, and second print data for the other side of the thermal paper.

6. The printer according to claim 5, wherein the first thermal head is provided in the downstream of the second thermal head in the thermal paper feeding direction, the first control section executes double-side printing, when the defect detection section defects no defect, by feeding the thermal paper, and operating the second thermal head according to the second print data, and then operating the first thermal head according to the first print data, the first control section executes one-side printing with the second thermal head, when the defect detection section defects a defect in the first thermal head, by feeding the thermal paper, and operating the second thermal head according to the first and second print data, and the first control section executes one-side printing with the first thermal head, when the defect detection section defects a defect in the second thermal head, by feeding the thermal paper, and operating the first thermal head according to the first and second print data.

7. The printer according to claim 1, further comprising:

a first front-end sensor which detects whether the front end of the thermal paper is set at a position before the first thermal head in the thermal paper feeding direction; and a second front-end sensor which detects whether the front end of the thermal paper is set at a position before the second thermal head in the thermal paper feeding direction.

8. The printer according to claim 7, wherein the second control section previously sets the front end of the thermal paper at a position before the second thermal head based on the detection result of the second front-end sensor, at the time of double-side printing, and the third control section previously sets the front end of the thermal paper at a position before the first thermal head based on the detection result of the first front-end sensor, at the time of one-side printing with the first thermal head, and previously sets the front end of the thermal paper at a position before the second thermal head based on the detection result of the second front-end sensor, at the time of one-side printing with the second thermal head.

9. A thermal printer comprising:

thermal paper, which has a thermosensitive layer on both sides, and is fed in a predetermined direction;

a first thermal head, which is provided at a position in the thermal paper feeding direction, and prints one side of the thermal paper;

a second thermal head, which is provided at a position apart from the first thermal head in the thermal paper feeding direction, and prints the other side of the thermal paper;

first control means for selectively executing both-side printing with both thermal heads, and one-side printing with one of the thermal head;

second control means for previously setting the front end of the thermal paper at a position before the thermal head provided in the upstream in the thermal paper feeding direction, when the first control means executes double-side printing; and third control means for previously setting the front end of the thermal paper at a position before the thermal head to be used, when the first control means executes one-side printing.

10. The printer according to claim 9, further comprising defect detection means for detecting a defect in the thermal heads.

11. The printer according to claim 10, wherein the first control means executing double-side printing, when the defect detection means detecting no defect, the first control means executes one-side printing with the second thermal head, when the defect detection means detecting a defect in the first thermal head, and the first control means executing one-side printing with the first thermal head, when the defect detection means detecting a defect in the second thermal head.

12. The printer according to claim 10, wherein the defect detection means includes:

a means for printing a mark on one side of the thermal paper with the first thermal head;

a means for printing a mark on the other side of the thermal paper with the second thermal head;

a first mark sensing means for detecting a mark printed on one side of the thermal paper;

a second mark sensing means for detecting a mark printed on the other side of the thermal paper;

a means for determining the first thermal head to be defective, when the first mark sensing means does not detecting a mark;

a means for determining the second thermal head to be defective, when the second mark sensing means does not detecting a mark.

13. The printer according to claim 10, further comprising data separation control means for separating print data into first print data for one side of the thermal paper, and second print data for the other side of the thermal paper.

14. The printer according to claim 13, wherein the first thermal head is provided in the downstream of the second thermal head in the thermal paper feeding direction, the first control means executes double-side printing, when the defect detection means defecting no defect, by feeding the thermal paper, and operating the second thermal head according to the second print data, and then operating the first thermal head according to the first print data, the first control means executes one-side printing with the second thermal head, when the defect detection means defecting a defect in the first thermal head, by feeding the thermal paper, and operating the second thermal head according to the first and second print data, and the first control means for executing one-side printing with the first thermal head, when the defect detection section defecting a defect in the second thermal head, by feeding the thermal paper, and operating the first thermal head according to the first and second print data.

15. The printer according to claim 9, further comprising:

a first front-end sensing means for detecting whether the front end of the thermal paper is set at a position before the first thermal head in the thermal paper feeding direction; and a second front-end sensing means for detecting whether the front end of the thermal paper is set at a position before the second thermal head in the thermal paper feeding direction.

16. The printer according to claim 15, wherein the second control means for previously setting the front end of the thermal paper at a position before the second thermal head based on the detection result of the second front-end sensing means, at the time of double-side printing, and the third control means for previously setting the front end of the thermal paper at a position before the first thermal head based on the detection result of the first front-end sensing means, at the time of one-side printing with the first thermal head, and previously setting the front end of the thermal paper at a position before the second thermal head based on the detection result of the second front-end sensing means, at the time of one-side printing with the second thermal head.

17. A method of controlling a thermal printer having:

thermal paper, which has a thermosensitive layer on both sides, and is fed in a predetermined direction; and a first thermal head for printing one side of the thermal paper, and a second thermal head for printing the other side of the thermal paper, which are provided at positions apart from each other along a thermal paper feeding direction, the method comprising:

selectively executing double-side printing with both thermal heads, and one-side printing with one of the thermal heads, previously setting the front end of the thermal paper at a position before the thermal head provided in the upstream in the thermal paper feeding direction, at the time of executing the double-side printing, and previously setting the front end of the thermal paper at a position before the thermal head to be used, at the time of executing the one-side printing.

* * * * *